US005964119A

United States Patent [19]

Kutschker

[11] Patent Number: 5,964,119

[45] Date of Patent: Oct. 12, 1999

[54] PROCESSING MACHINE

[75] Inventor: Wolfgang Kutschker, Boeblingen, Germany

[73] Assignee: Reinhardt Maschinenbau GmbH, Sindelfingen, Germany

[21] Appl. No.: 09/086,375

[22] Filed: May 28, 1998

Related U.S. Application Data

[63] Continuation of application No. PCT/EP97/04997, Sep. 12, 1997.

[30] Foreign Application Priority Data

Sep. 30, 1996 [DE] Germany ..... 196 40 415
Oct. 8, 1996 [DE] Germany ..... 196 41 402

[51] Int. Cl.[6] ..... B21D 5/04; B21D 43/00

[52] U.S. Cl. ..... 72/306; 72/319; 72/420

[58] Field of Search ..... 72/306, 307, 319, 72/323, 420

[56] References Cited

U.S. PATENT DOCUMENTS

| | | | |
|---|---|---|---|
| 4,242,898 | 1/1981 | Salvagnini | 72/306 |
| 4,510,785 | 4/1985 | Triouleyre | 72/319 |
| 5,182,936 | 2/1993 | Sartorio | 72/420 |
| 5,187,958 | 2/1993 | Prunotto | 72/420 |

FOREIGN PATENT DOCUMENTS

| | | |
|---|---|---|
| 0 097 637 | 1/1984 | European Pat. Off. . |
| 0 742 054 | 11/1996 | European Pat. Off. . |
| 42 22 741 | 4/1993 | Germany . |

*Primary Examiner*—Daniel C. Crane
*Attorney, Agent, or Firm*—Barry R. Lipsitz; Ralph F. Hoppin

[57] ABSTRACT

In order to improve a processing machine for workpieces consisting of flat material, in particular, sheet-metal parts, comprising a work station which is designed as a bending station, in which the workpiece aligned parallel to a bending plane can be clamped by means of a lower beam and an upper beam for carrying out a bending operation and bent along a bending edge by means of a bending beam, as well as a manipulator device with a gripping means for holding the workpiece and a positioning device for the gripping means, with which this can be moved in the bending plane in a first direction transversely to the bending edge and rotated about an axis at right angles to the bending plane, such that other machining operations are possible with it in addition to one type of bending operation in order to finish a sheet-metal part at least with respect to its shaping it is suggested that the gripping means be movable with the positioning device in a second direction parallel to the bending plane and in a vertical direction at right angles to the bending plane.

20 Claims, 5 Drawing Sheets

76
Z
X
Y
16
130
D
62
140
128
126
132
134
114
122
116
12b
22e
142
144
136
138
112

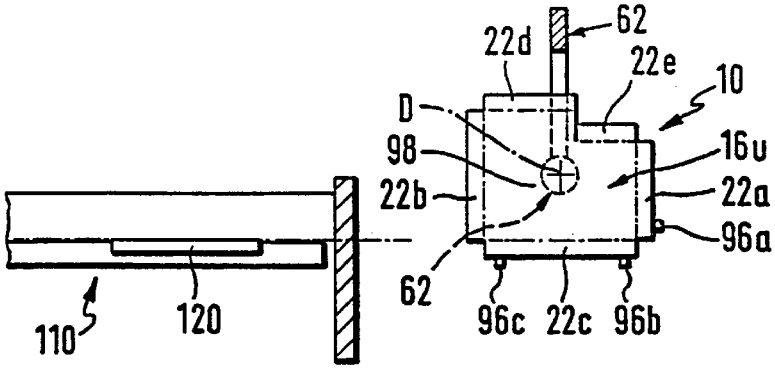
Fig. 4a
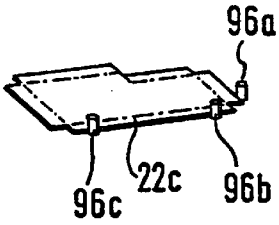
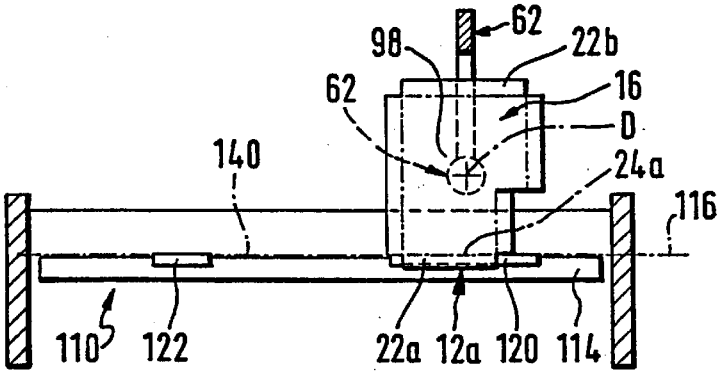
Fig. 4b
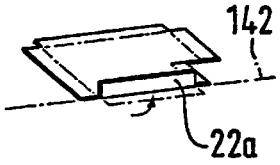
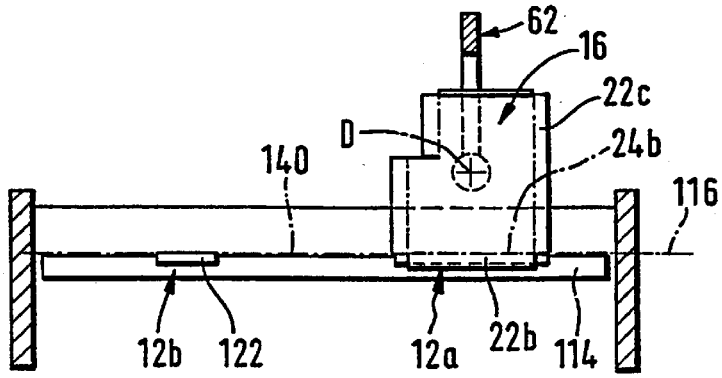
Fig. 4c
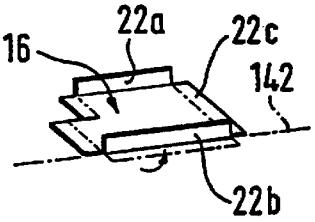
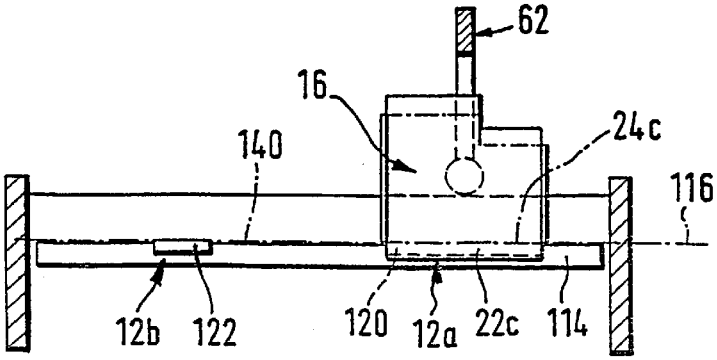
Fig. 4d
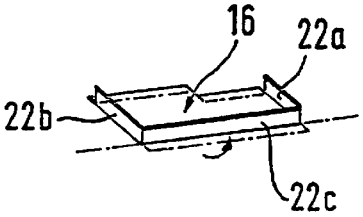

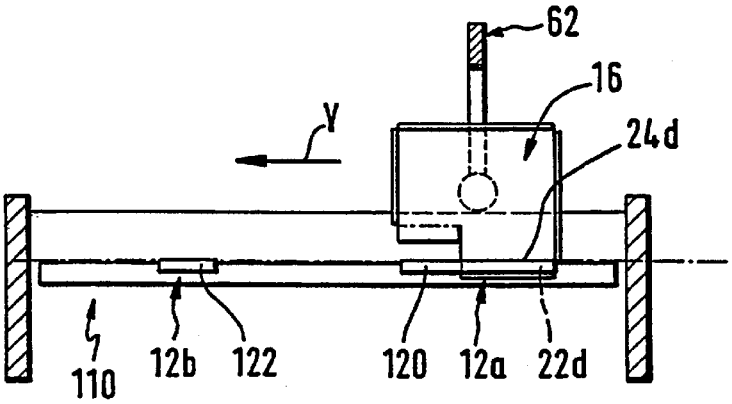
Fig. 4e
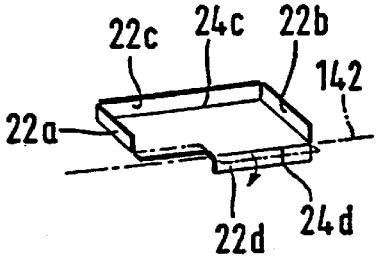
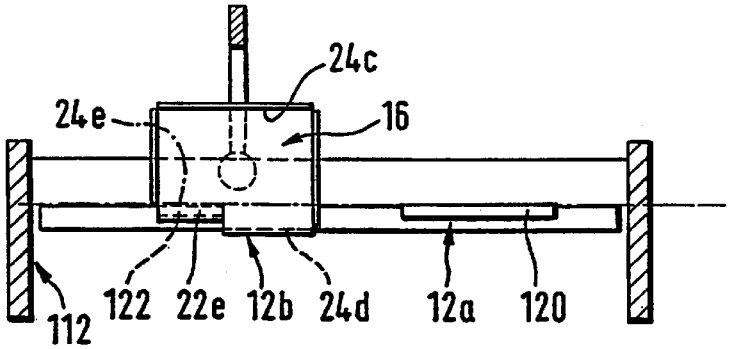
Fig. 4f
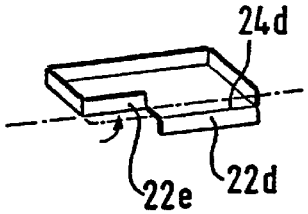
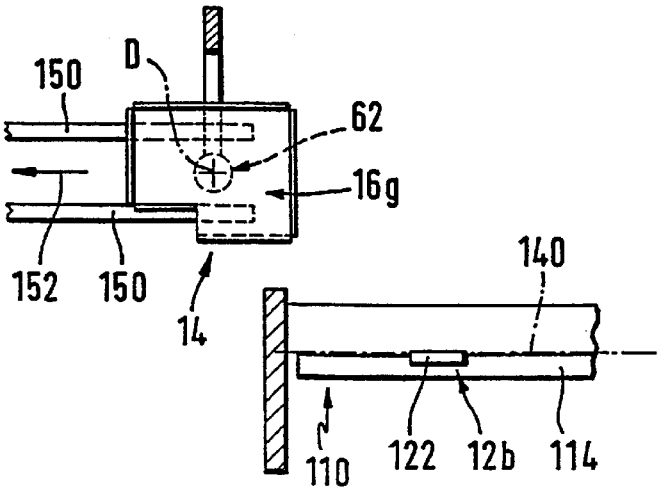
Fig. 4g
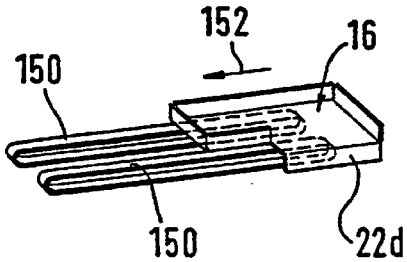

PROCESSING MACHINE

This application is a continuation of International PCT Application No. PCT/EP97/04997 filed on Sep. 12, 1997.

BACKGROUND OF THE INVENTION

The invention relates to a processing machine for workpieces consisting of flat material, in particular, sheet-metal parts, comprising at least one work station which is designed as a bending station, in which the workpiece aligned parallel to a bending plane can be clamped by means of a lower beam and an upper beam for carrying out a bending operation and can be bent along a bending edge by means of a bending beam, as well as a manipulator device with a gripping means for holding the workpiece and a positioning device for the gripping means, with which this can be moved in the bending plane in a first direction transversely to the bending edge and rotated about an axis at right angles to the bending plane.

Processing machines of this type are known from the state of the art as bending centers, wherein in their case it is merely possible to carry out only one type of bending operation and, in addition, only a limited number thereof, as well.

SUMMARY OF THE INVENTION

The object underlying the invention is therefore to improve a processing machine of the generic type such that other machining procedures are possible with it in addition to one type of bending operation in order to finish a sheet-metal part at least with respect to its shaping.

This object is accomplished in accordance with the invention, in a processing machine of the type described at the outset, in that the gripping means is movable with the positioning device in a second direction parallel to the bending plane and in a vertical direction at right angles to the bending plane.

With this inventive solution, the possibility is created of carrying out several different bending operations with the inventive processing machine and also different machining procedures for the sheet-metal part. For example, it is possible with this design of the inventive processing machine to carry out, on the one hand, bending operations, with which one edge region is bent in one direction, and, on the other hand, bending operations, with which one edge region is bent in an opposite direction.

For this purpose, the positioning device can be designed in the most varied of ways.

For example, for realizing the movement in one of the directions, it is provided for the positioning device to have a longitudinal guide means extending parallel to a longitudinal direction, a longitudinal slide bearing the gripping means being held on this guide means. With a positioning device of this type, a movement of the gripping means in the longitudinal direction can be realized in a simple manner, particularly when a movability of the gripping means in the longitudinal direction over long distances is intended to be realized.

The adjustment of the gripping means at right angles to the bending plane can also be realized in the most varied of ways. It would, for example, be conceivable to position the gripping means in the vertical direction relative to the longitudinal slide with a suitable vertical adjustment device. It is, however, even more advantageous, in particular, in order to obtain an exact and stable positioning of the gripping means, when the longitudinal guide means is adjustable in the vertical direction by means of a vertical adjustment device. This means that the vertical adjustment of the gripping means does not take place between the longitudinal slide and the gripping means but rather the entire longitudinal guide means is arranged so as to be vertically adjustable. As a result, the advantage is also achieved that the vertical adjustment, which is necessary the least frequently, does not impair the dynamics of the movement of the gripping means in longitudinal direction and transverse direction, transverse to the bending line, and so these movements can be carried out very quickly.

The vertical adjustment device is preferably designed such that it has a parallel guide means for the longitudinal guide means held on a machine frame so that the longitudinal guide means can be moved as a whole in the vertical direction into positions parallel to one another.

In order to realize the movement in a further one of the directions, and beforehand in a transverse direction extending transversely to the longitudinal direction, it is preferably provided for a transverse guide means with a cross slide movable along it to be arranged on the longitudinal slide so that the cross slide, for its part, then bears the gripping means.

The gripping means itself could be designed in the most varied of ways. It would be conceivable, for example, to design the gripping means as a suction gripper which engages on the workpiece on one side in a suction manner. It would, however, also be conceivable to design the gripping means as a magnetic gripper which likewise engages on the workpiece on one side under the influence of magnetic forces, which does, however, presuppose that the workpiece consists of a material which is subject to the magnetic attraction by a magnet.

A particularly universal solution which also grips the workpiece securely provides for the gripping means to grip the workpiece with gripping elements extending over it on an upper side and a lower side. Such a mechanical and force-locking gripping of the workpiece can be used universally for any type of workpiece and, in addition, permits the most reliable force-locking fixing of the workpiece.

In this respect, the gripping means could be designed such that it grips the workpiece, for example, as a clamp-type gripper in a respective edge region. It is, however, particularly advantageous, particularly in order to be able to grip and hold the workpiece securely, when the gripping means has an approximately C-shaped gripper bracket, on which the gripping elements are held.

The C-shaped gripper bracket is preferably designed such that the workpiece can be gripped with the gripping elements in a central region thereof.

Such a gripping of the workpiece in a central region has the great advantage that during bending of different edge regions the reshaping of the edge regions has no influence on the central region, in which the gripping takes place, and thus has no influence on the gripping of the workpiece.

In order, in addition, to be able to carry out a rotation of the workpiece about the axis at right angles to the bending plane with as little space requirement as possible it is preferably provided for the gripping elements to be arranged on the gripper bracket so as to be rotatable relative thereto so that the gripper bracket itself need not be subjected to any rotation but rather the workpiece can be rotated simply due to the fact that the gripping elements themselves are rotatable relative to the gripper bracket.

Due to the fact that any regripping of the workpiece is superfluous, the reliability of the inventive processing device is considerably improved since each gripping of the workpiece opens up the possibility of a gripping error and thus with each renewed gripping it is necessary to check the correct gripping of the workpiece. Moreover, a renewed gripping of the workpiece always opens up the possibility of this being gripped with a positional error relative to the gripping means and thus—when this faulty positioning is not recognized—of positioning the workpiece erroneously for the next processing operation. For this reason, a means for ensuring that no faulty positioning takes place must be provided for each renewed gripping and this is superfluous in the case of the inventive gripping in a central region of the workpiece.

In principle, it would be possible, when providing a C-shaped gripper bracket, to move the arms of the gripper bracket towards one another in order to grip the workpiece.

A particularly favorable solution does, however, provide for at least one of the gripping elements to be held on the gripper bracket so as to be movable in a direction towards the other gripping element and away from it. This solution offers the possibility of designing the gripper bracket as such in a rigid manner and, thus, of only moving at least one of the gripping elements relative t the bracket.

The gripping elements can by designed in the most varied of ways. For example, it would be conceivable to provide as gripping elements a plate-like gripping member and as counterpart to this a bell-shaped gripping member in order to grip the workpiece in the central region over as large a surface area as possible. Alternatively thereto, it is, however, also conceivable, in particular, when the sheet-metal parts are small to provide as gripping elements two strip-like gripping elements which can be moved towards one another.

In conjunction with the preceding explanations concerning the inventive solution it has merely been assumed that the inventive processing machine has at least one work station designed as a bending station.

A solution utilizing, in particular, the advantages of the inventive bending machine, provides for the workpiece to be positionable with the gripping means in several work stations arranged one after the other in the longitudinal direction. This solution has the great advantage that not just one work station designed as a bending station is available for the machining of the workpiece but additional work stations, in which the most varied of machining operations can, in principle, be carried out. Examples for such different machining operations would be, apart from bending, any types of deforming operations but also punching, cutting or labeling or even metal-removing operations.

With this inventive solution the possibility is created for the first time of not only bending a sheet-metal part but of machining it in many different ways, even, in the extreme case, essentially completely.

With respect to the transport of the workpiece to the at least one bending station and the transport of the workpiece away from the one bending station it is particularly favorable when the longitudinal direction extends parallel to the bending edge in the bending station.

In order to also be able to carry out, in particular, the most varied of bending operations with bending tools adapted in accordance with the different bending operations, it is advantageously provided for at least one of the additional work stations to be designed as a bending station. This creates the possibility of providing different bending tools in the individual bending stations, particularly with different widths, as well, in order to be able to work with tools adapted precisely to the respective bending operation. This is important, in particular, when only partial areas of a workpiece are intended to be bent without colliding with the remaining workpiece.

When providing several bending stations, it has proven to be particularly advantageous when the bending edges of all the bending stations extend parallel to the longitudinal direction since the handling of the workpiece is then possible in a particularly simple manner during the transport into the bending station and away from the bending station.

Since the workpiece can be machined with the inventive processing machine, in any case, only in one of the work stations at a specific point of time, a particularly expedient solution provides for all the bending stations to have a common lower beam, a common upper beam and a common bending beam. This design of the bending stations creates the possibility of operating with as few drive and control resources as possible since only one drive for moving lower beam and upper beam relative to one another and one drive for moving the bending beam are required in order to be able to operate all the bending stations.

In this respect, it is, in particular, favorable when each bending station has its own bending beam tool, wherein this bending beam tool is seated on the bending beam common to all the bending stations.

In continuation of this concept, it is, furthermore, expedient when each bending station has its own upper beam tool and/or its own lower beam tool which are, however, all seated on the respective lower beam or upper beam common to all the bending stations.

In conjunction with the embodiments explained thus far no details have been given as to how the workpiece is intended to be supplied to the inventive processing machine. It would, for example, be conceivable to insert the workpiece directly into a work station and then have it taken up by the gripping means. A particularly favorable solution does, however, provide for the workpiece to be supplied to a feed station of the processing machine and picked up with the gripping means in it. The provision of such a feed station has the advantage that a feeding of the workpiece, for example, manually or with corresponding conveyor means can take place in it irrespective of the design of the work stations and without interfering with operational cycles.

It is particularly expedient when the workpiece can be positioned exactly in the feed station. This solution creates the advantage of already gripping the workpiece in the feed station in a defined alignment by way of the gripping means and then of inserting the workpiece into the next following work station, proceeding from this defined alignment known to a machine control, aligned in a defined manner and controlled by the machine control.

The defined alignment of the workpiece in the feed station could be brought about in the most varied of ways. For example, it would be possible to measure the workpiece in the feed station. However, a particularly inexpensive solution provides for the workpiece to be positionable exactly in the feed station by way of stop elements provided in it.

A particularly expedient alignment of the workpiece is possible when this can be placed on a table in the feed station and positioned on it in a defined manner.

With respect to the removal of the workpiece, no details have likewise been given in conjunction with the preceding description of the individual embodiments. It would, for example, likewise be conceivable to accomplish the removal of the sheet-metal part by this being transported away from the last work station. It is, however, particularly favorable when the workpiece can be fed to a removal station after passing through the work stations. Such a solution has the great advantage that the removal station can be designed without taking the design and mode of operation of the respectively last work station into account and thus the most varied of sheet-metal parts can also be transported away from the same removal station.

A solution is particularly expedient, in which the removal station has one or several conveyor belts, onto which the workpiece can be placed by way of the gripping means.

In conjunction with the preceding explanations concerning the inventive solution, no details have been given as to how the workpieces are held in the individual work stations. It would, for example, be conceivable to place the workpieces, for feeding to the individual work stations, on tables associated with them, for example, on tables extending parallel to the bending plane. Since—in particular during bending—an additional fixing in position of the sheet-metal part takes place in any case in the respective work station, one advantageous solution provides for the workpiece to be held only by the gripping means during feeding to the individual work stations and during removal from them. This solution makes not only a reduction in costs possible with respect to the tables required but it also makes it possible to adapt the handling of the workpiece by the gripping means to the respective requirements essentially as desired without having to take into account the geometry of the table during the handling of the workpiece.

Since—as already mentioned—the workpiece is fixed in position in individual work stations, at least in the bending stations, in addition to the gripping means, it would be conceivable in these cases to no longer hold the workpiece by way of the gripping means after its fixing in position in the individual work stations and thus to have the possibility of regripping during the processing of the workpiece in the individual processing stations.

With respect to the positional accuracy in the inventive processing machine, it is, however, far more favorable when the workpiece can be gripped in a single alignment relative to the gripping elements, particularly between the feed station and the removal station, i.e. that no regripping takes place, for example, between the feed station and the removal station, and thus the single defined positioning of the workpiece, for example, in the feed station leads to a single defined alignment relative to the gripping elements which is then maintained for the entire machining operations. This means that the determination of this single alignment relative to the gripping elements with the desired accuracy up to the termination of all the processing operations in all the work stations is sufficient for the positioning of the workpiece in all the work stations.

Additional features and advantages of the inventive solution are the subject matter of the following description as well as the drawings illustrating one embodiment of an inventive processing machine.

BRIEF DESCRIPTION OF THE DRAWINGS

FIG. 3 shows a perspective view illustrated in cross section in the direction of arrow B in FIG. 1 of the bending unit in the region of the second work station and FIG. 4 shows a schematic illustration of machining of an exemplary workpiece, wherein the machining in the inventive processing machine is illustrated each time on the left side and the shape of the sheet-metal part after the machining on the right side. The drawings show in detail FIG. 4*a* feeding of the sheet-metal part to the feed station and pick-up thereof by the gripping means;

FIG. 4*b* bending over of a first edge region in the first work station;

FIG. 4*c* bending over of an oppositely located, second edge region in the first work station;

FIG. 4*d* bending over of a third edge region in the first work station;

FIG. 4*e* bending over of a fourth edge region in the first work station;

FIG. 4*f* bending over of a fifth edge region in the second work station and FIG. 4*g* feeding of the finished sheet-metal part to the removal station.

DETAILED DESCRIPTION OF THE INVENTION

Figure 1:
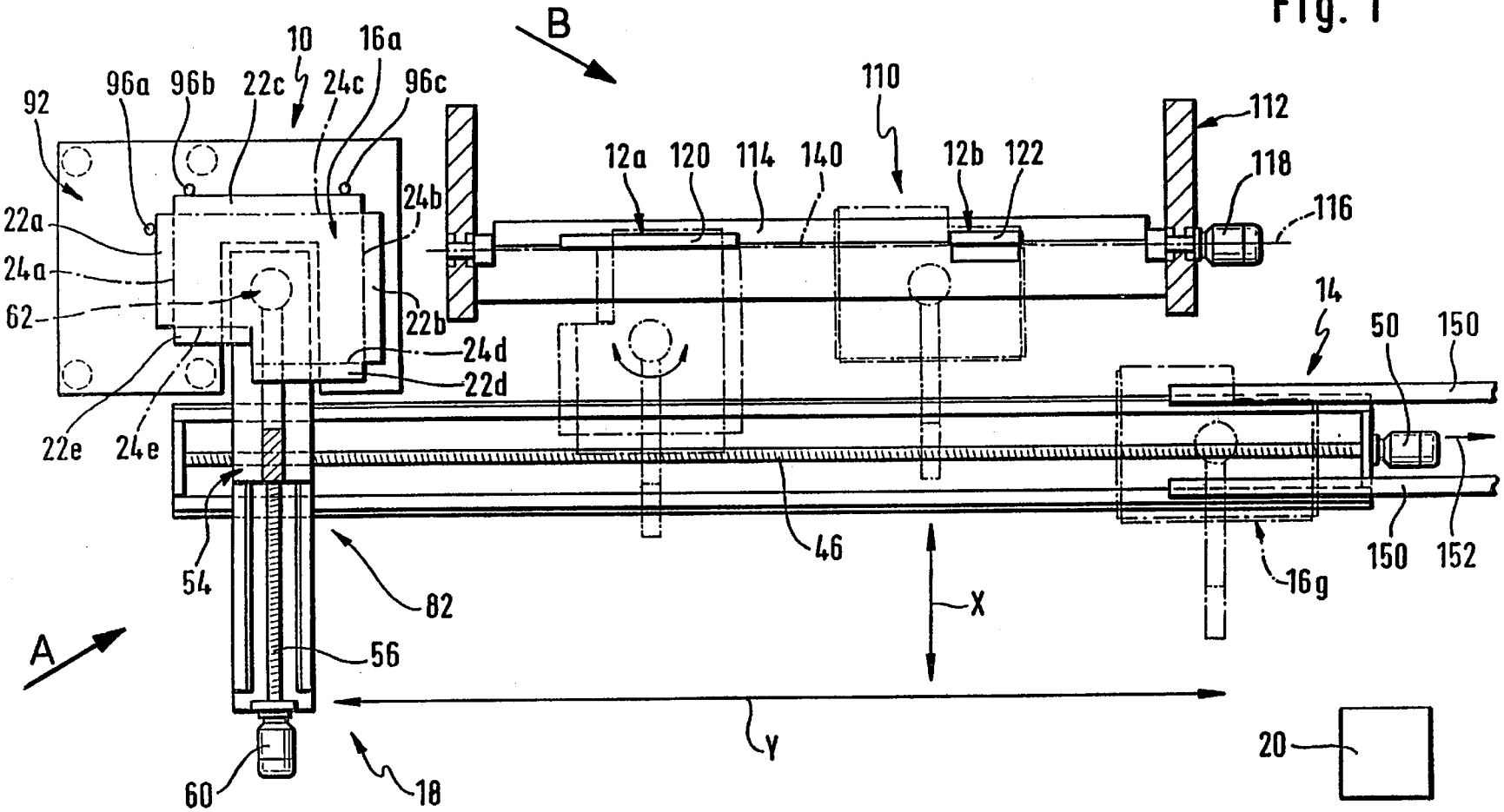
FIG. 1 shows a plan view of an embodiment of an inventive processing machine.

One embodiment of an inventive processing machine, illustrated as a whole in FIG. 1 and designed by way of example as a bending machine, comprises a feed station 10, work stations 12*a* and 12*b* which are merely examples for a number of work stations to be selected depending on the type of machining, and a removal station 14.

In order to transport a workpiece 16, in this case a sheet-metal part to be bent, from the feed station 10 to the work stations 12*a* and 12*b* as well as to the removal station 14 of the processing machine, this is provided with a manipulator device which is designated as a whole as 18 and can be controlled by means of a machine control 20. The sheet-metal part 16 is taken up in the feed station 10 with this manipulator device 18 and transported to the work stations 12*a* and 12*b* such that edge regions 22*a*, 22*b*, 22*c*, 22*d* and 22*e* can be bent over in them along bending lines 24*a*, 24*b*, 24*c*, 24*d* and 24*e*.

Figure 2:
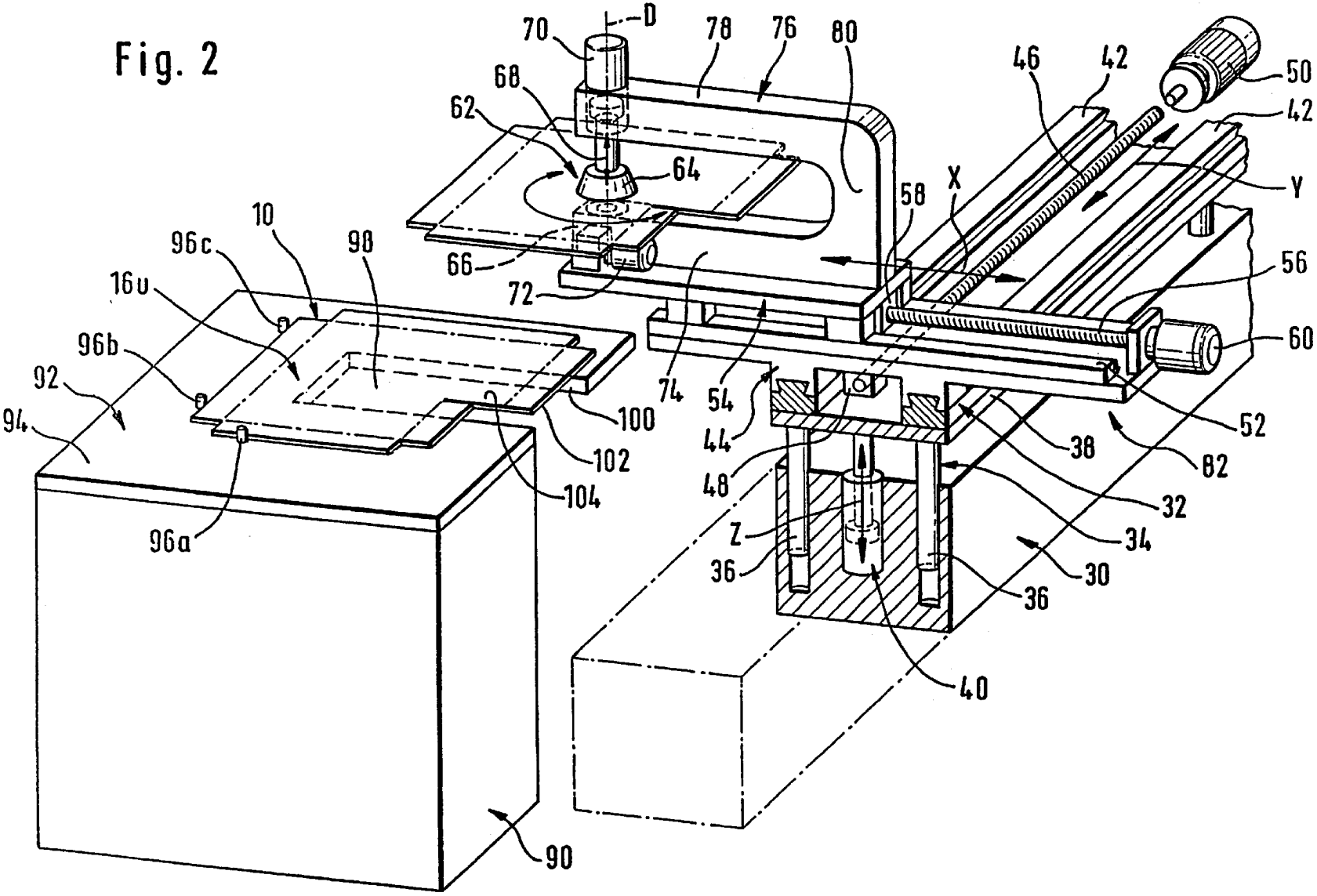
FIG. 2 shows a perspective view partially illustrated in cross section in the direction of arrow A in FIG. 1 of the manipulator arrangement and the feed station.

For this purpose, the manipulator device 18 comprises, as illustrated in FIG. 2, a manipulator frame which is designated as a whole as 30 and relative to which a longitudinal guide means 32 is held so as to be vertically adjustable in the direction of a vertical direction Z by means of a vertical adjustment device 34. The vertical adjustment device 34 comprises several parallel guide means 36 which guide a base 38 of the longitudinal guide means 32 parallel to the vertical direction Z. In addition, the vertical adjustment device 34 comprises lifting means 40, for example, in the form of hydraulic cylinders, with which the base 38 can be moved in the vertical direction Z in a defined manner.

The longitudinal guide means 32 comprises, for its part, two longitudinal guide paths 42 which extend parallel to one another and, in addition, parallel to a longitudinal direction Y, wherein the longitudinal direction Y extends preferably in horizontal direction whereas the vertical direction Z extends preferably in perpendicular direction.

A longitudinal slide designated as a whole as 44 is mounted on the longitudinal guide paths 42 for displacement in the longitudinal direction Y. A threaded spindle 46, the spindle nut 48 of which is securely connected to the longitudinal slide and which can be driven in a controlled manner via a spindle drive 50 driven by the machine control 20, is provided for driving the longitudinal slide 44.

Two transverse guide paths 52, which extend parallel to one another and on which a cross slide 54 can be displaced in a transverse direction X transversely to the longitudinal direction Y, are arranged on the longitudinal slide 44. This cross slide 54 can also be preferably adjusted in the transverse direction X by means of a threaded spindle 56, the spindle nut 58 of which is securely seated on the cross slide 54, and can be controlled by the machine control 20 through a transverse spindle drive 60.

A gripping means designated as a whole as 62 is seated on the cross slide 54 and this comprises an upper gripping element 64 and a lower gripping element 66, wherein the upper gripping element 64 can be moved, for example, in a direction 68 towards the lower gripping element or away from it in order to grip the sheet-metal part 16. For this purpose, the upper gripping element 64 can be adjusted by means of a gripper drive 70, for example, in the form of a hydraulic cylinder.

Furthermore, the lower gripping element 66 is rotatable about an axis D which extends parallel to the direction 68. For this purpose, the lower gripping element 66 can be driven by means of a rotary drive 72.

The lower gripping element 66 is, for its part, rotatably held on a lower arm 74 of a gripper bracket designed in a C shape and designated as a whole as 76, wherein the rotary drive 72 is also arranged on the lower arm 74. Furthermore, the upper gripping element 64 is held on an upper arm 78 of the C-shaped gripper bracket so as to be displaceable in the direction 68 and the upper arm 78 bears, in addition, the gripper drive 70. In order to be able to also rotate the workpiece gripped between the upper gripping element 64 and the lower gripping element 66 about the axis D, the upper gripping element 64 is also mounted on the upper arm 78 of the C-shaped gripper bracket 76 so as to be rotatable about the axis D, in addition. The C-shaped gripper bracket 76 is, for its part, seated on the cross slide 54 and extends with its arms 74 and 78 approximately parallel to the transverse direction X, wherein the arms 74 and 78 are rigidly connected to one another via a web 80 which is located on a side of the arms 74 and 76 located opposite the gripping elements 64, 66.

The longitudinal direction Y and the transverse direction X are preferably parallel to a horizontal plane and the axis of rotation D is at right angles to this.

In order to be able to grip the workpiece 16 in the feed station 10 in a simple manner, the gripping means 62 is arranged such that its gripping elements 64 and 66 are arranged so as to face the feed station 10 as well as the work stations 12*a* and 12*b* and the removal station 14 whereas the web 80 is arranged opposite the gripping elements 64 and 66 when seen in transverse direction X.

The vertical adjustment device 34 forms together with the longitudinal guide means 32, the longitudinal slide 44 and the cross slide 54 as well as the drives 50 and 60 a positioning device 82 for the gripping means 62 controllable by the machine control 20.

The feed station 10 comprises for its part, as likewise illustrated in FIG. 2, a base frame 90 which bears a table 92 with a table surface 94, onto which the sheet-metal part 16*u* still unmachined can be placed. In order to bring about an exact positioning of the unmachined sheet-metal part 16*u*, stop elements 96*a*, 96*b* and 96*c* are provided on the table 92, against which the sheet-metal part 16*u* can abut with the edge regions 22*a* and 22*c* and thereby be clearly positioned in a defined manner with respect to its position relative to the longitudinal direction Y and the transverse direction X.

In order to open up the possibility of the gripping elements 64 and 66 gripping the sheet-metal part 16*u* in a central region 98, the table 92 is provided with a recess 100 which, in the case of a sheet-metal part 16 positioned by the stop elements 96*a* to *c* in a defined manner, allows the lower gripping element 66 to abut on an underside 102 of the sheet-metal part in the central region 98 while the upper gripping element 64 can abut at the same time on an upper side 104 of the sheet-metal part 16 in the central region 98 and thus the sheet-metal part 16 can be clamped between the gripping elements 66 and 64, wherein the gripper drive 70 acts in this case on the upper gripping element 64 with a clamping force in the direction of the lower gripping element 66.

The sheet-metal part 16 can therefore be taken up by the gripping means 62 in the feed station 10 in a defined alignment relative to the longitudinal direction Y and transverse direction X.

As illustrated schematically in FIG. 1, both work stations 12*a* and 12*b* are arranged in a bending unit which is designated as a whole as 110 and has a bending unit frame 112, on which a bending beam designated as a whole as 114 is arranged so as to be pivotable about a pivot axis 116, wherein a pivot drive 118 is provided for this purpose.

A first bending beam tool 120 associated with the first work station 12*a* is seated on the bending beam 114 of the bending unit 110 and, moreover, at a distance from this a second bending beam tool 122 associated with the second work station 12*b*, these tools being movable about the pivot axis 116 by means of a common pivoting movement of the bending beam 114.

Figure 3:
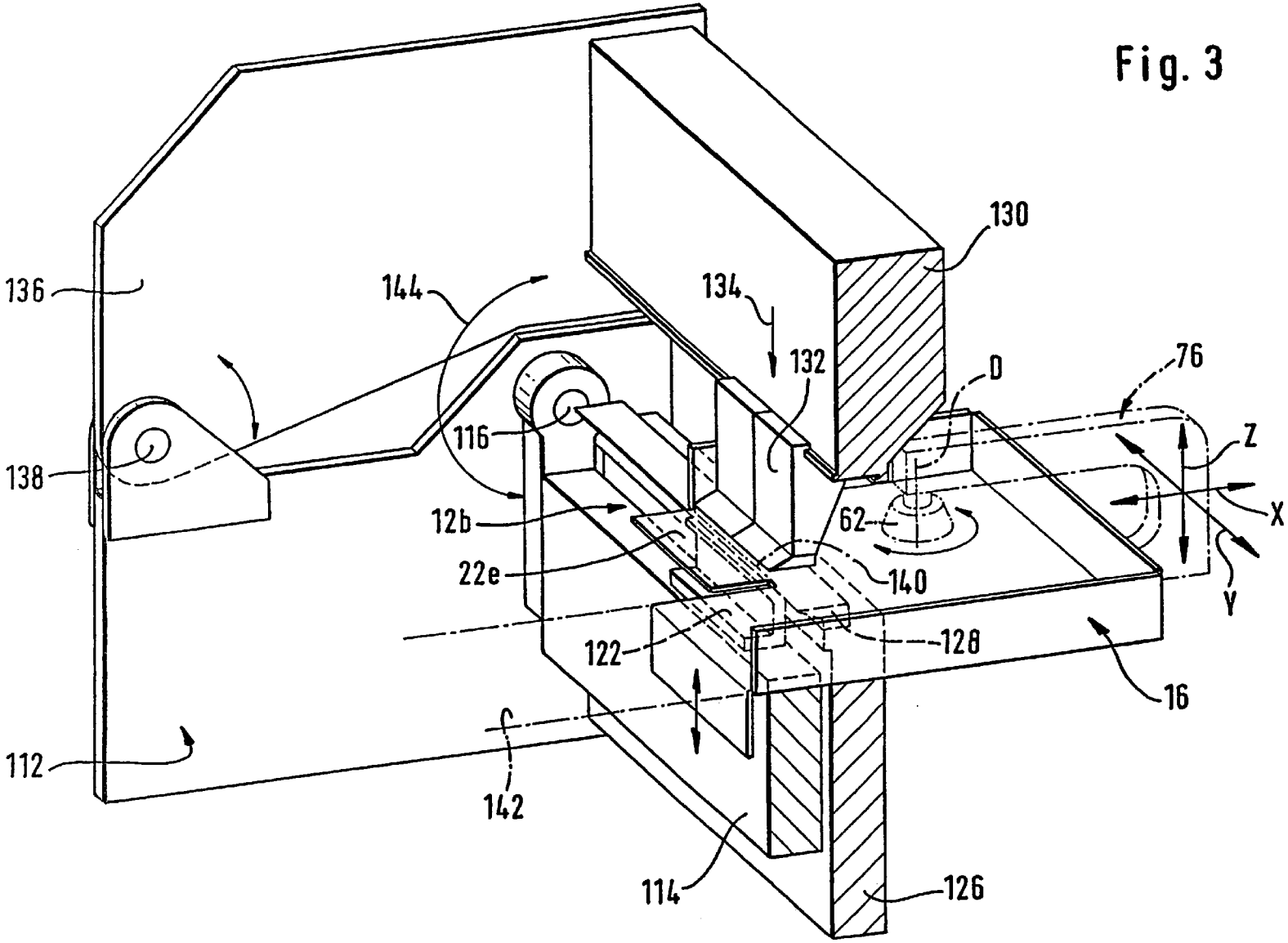

In order to be able to clamp the workpiece 16 rigidly in the individual work stations 12*a* and 12*b* for carrying out the bending operations, the bending unit 110 comprises, in addition, a lower beam 126 with a lower beam tool 128, which is illustrated in FIG. 3 by way of example in conjunction with the second work station 12*b* and is securely connected to the bending unit frame 112, as well as an upper beam 130 with an upper beam tool 132 which is movable relative to the lower beam 126 in a clamping direction 134. For this purpose, the upper beam 130 is mounted on the bending unit frame 112 via an arm 136 so as to be pivotable about an axis 138.

The lower beam 126 and the upper beam 130 also extend through the region of the first work station 12*a* and likewise bear in this region lower beam tools 128 and upper beam tools 132 required for the bending operations to be carried out there.

The lower beam tools 128 and the upper beam tools 132 preferably define a uniform bending edge 140 which extends through both work stations 12*a* and 12*b* and about which a bending operation can be carried out by means of the bending beam 114 and the respective bending beam tools 120 or 122.

As illustrated in FIG. 1, in addition, the bending edge 140 preferably extends parallel to the longitudinal direction Y of the manipulator device 18 and, in addition, as illustrated in FIG. 3, the lower beam tools 128 and the upper beam tools 132 are arranged such that they fix the workpiece 16 in position in the clamped state with its central region 98 located in a bending plane 142 which extends parallel to the longitudinal direction Y and to the transverse direction X.

As illustrated in FIG. 3, the respective edge region 22 to be bent over can thus be bent out of the bending plane 142 as a result of pivoting the bending beam 114 about the pivot axis 116 in a bending pivot direction 144, wherein the respective bending beam tool provided, in FIG. 3 the second bending beam tool 122, acts on the respective edge region 22 immediately next to the bending edge 140 during pivoting of the bending beam 114.

The bent sheet-metal part 16*g* which is finally finished can be placed on the removal station 14 after all the bending operations have been carried out. This removal station comprises two conveyor belts 150, which extend parallel to one another and with which the finished sheet-metal part 16*g* placed on them can be transported away in a removal direction 152.

The function of an inventive processing machine is illustrated in FIGS. 4*a* to 4*g* with the example of the sheet-metal part 16.

As shown schematically in FIG. 4*a,* the sheet-metal part 16 is inserted into the inventive processing machine in that it is placed with the edge regions 22*a* and 22*c* against the stop elements 96*a* to *c* and is thereby clearly positioned in its feed position.

In this feed position, the sheet-metal part 16*u* which is still unbent is taken up by the gripping means 62 illustrated schematically, wherein this grips the sheet-metal part 16*u* in the central region 98.

As illustrated in FIG. 4*b,* the sheet-metal part 16 is then transported into the first work station 12*a,* wherein the sheet-metal part 16 is turned through 90° in relation to its alignment in the feed station 10 so that the edge region 22*a* can be bent over in the first work station 12*a,* namely along the bending line 24*a*. For this purpose, the sheet-metal part 16 is inserted into the first work station 12*a* such that the bending line 24*a* is arranged in congruence with the bending edge 140 of the bending unit 110, wherein for the purpose of inserting the sheet-metal part the upper beam 130 is lifted contrary to the clamping direction 134 and following exact positioning of the sheet-metal part 16 moved in the direction of the lower beam 126 in order to clamp the sheet-metal part 16 between the lower beam tool 128 and the upper beam tool 132. At the same time, the sheet-metal part 16 clamped in this manner is still held, in addition, by the gripping means 62.

By moving the bending beam 114 from a bending start position, in which this is in front of the lower beam 126 (FIG. 3), in the bending pivot direction 144, the edge region 22*a* is bent upwards out of the bending plane 142 in the direction of the upper beam tool 132 by means of the first bending beam tool 120.

After the edge region 22*a* has been bent up the upper beam 130 is moved upwards contrary to the clamping direction 134 to such an extent that by moving the sheet-metal part 16 in the bending plane 142 in X direction and at the same time rotating it about the axis D the edge region 22*b* is inserted into the work station 12*a* in order to carry out bending along the bending line 24*b*. For this purpose it is necessary to rotate through 180° about the axis D and to bring the bending line 24*b* into congruence with the bending edge 140 by moving the workpiece 16 in X direction. As a result of a movement of the upper beam 130 in the clamping direction 134 the workpiece 16 is clamped and as a result of a subsequent movement of the bending beam 114 in the bending pivot direction 144 the edge region 22*b* is again bent up out of the bending plane 142 so that the edge region 22*b* is parallel to the edge region 22*a,* as illustrated in FIG. 4*c*.

As illustrated in FIG. 4*d,* the edge region 22*c* is bent up following the bending up of the edge region 22*b,* wherein, as shown by a comparison of FIG. 4*c* and FIG. 4*d,* it is necessary to rotate the sheet-metal part 16 through 90° about the axis D and at the same time move it in X direction in order to bring the bending line 24*c* into congruence with the bending edge 140.

Furthermore, the upper beam tool 120 in the first work station 12*a* is dimensioned such that it is in a position to engage between the upturned edge regions 22*a* and 22*b*.

If the bending line 24*c* is the longest of all the bending lines 24, the upper beam tool 120 is dimensioned such that this can engage exactly between the upturned edge regions 22*a* and 22*b*.

After clamping the workpiece 16, the edge region 22*c* is bent up in the same manner as already described in conjunction with FIGS. 4*b* and 4*c* by pivoting the bending beam 114.

During the next bending procedure, the edge region 22*d* is bent over, as illustrated in FIG. 4*e,* along the bending line 24*d,* wherein the edge region 22*d* is intended, in this case, to be bent out of the plane 142 downwards, i.e. in the direction towards the lower beam tool 128. For this purpose, the bending beam 114 is brought into a bending start position, in which it is in front of the upper beam 130 and then pivoted in bending direction so that the sheet-metal part 16 clamped between the lower beam tool 128 and the upper beam tool 132 is held in the bending plane 142 itself and only the edge region 22*d* is moved in the direction of the lower beam tool 128.

Proceeding from the position of the sheet-metal part 16 in FIG. 4*d,* it is necessary for this purpose, after bending over the edge region 22*c,* to rotate the sheet-metal part 16 about the axis D through 180° and at the same time to correct the position of the sheet-metal part in X direction accordingly.

Subsequently, the edge region 22*e* is bent, which is narrower than the edge region 22*d* and, as illustrated in FIG. 4*f*, requires bending about a bending line 24*e* which extends parallel to the bending line 24*d* but is arranged so as to be offset in the direction of the bending line 24*c*.

For this purpose, the entire sheet-metal part 16 is displaced from the first work station 12*a* into the second work station 12*b,* as illustrated in FIG. 4*e* and FIG. 4*f*. In the simplest case, this is carried out merely by moving the entire gripping means 62 in the longitudinal direction Y, for example, without removing the sheet-metal part 16 from the bending unit 110.

In order to bend over the edge region 22*e,* the second bending beam tool 122 is provided which is adapted exactly to the width of the edge region 22*e,* i.e. the length of the bending line 24*e*, so that no collision whatsoever takes place between the second bending beam tool 122 and the remaining areas of the sheet-metal part 16. If, as illustrated in this example, the edge region 22*e* is bent upwards in the direction of the upper beam tool 132, the bending beam 114 is again positioned in the bending start position illustrated in FIG. 3 and pivoted in the bending pivot direction 144 in the same way as that described in conjunction with the bending up of the edge regions 22*a* to 22*c*.

In order to be able to remove the sheet-metal part 16 from the second work station 12*b* with edge region 22*d* bent downwards, it is necessary to lift the sheet-metal part 16 upwards above the bending plane 142 in the direction of the upper beam 130 so that removal of the sheet-metal part can be brought about without the bent edge region 22*d* colliding with the lower beam tool 128. For this purpose, the gripping means 62 is lifted by the vertical adjustment device 34 which acts on the longitudinal guide means 32 and after the gripping means 62 has been lifted it is moved in X direction in such a manner that the sheet-metal part 16 is moved out of the bending unit 110 away from the bending edge 140.

The finished sheet-metal part 16*g* lifted in this way is moved out of the second work station 12*b* and deposited in the removal station 14 and thereby placed on the two conveyor belts 150 which then move the sheet-metal part in removal direction 152.

The conveyor belts 150 are located with their upper edge such that in order to place the finished sheet-metal part 16 on them it can be lowered again to the level of the bending plane 142.

I claim:

1. A processing machine for workpieces consisting of flat material, comprising:

a work station designed as a bending station, wherein a workpiece aligned parallel to a bending plane is adapted to be clamped by means of a lower beam and an upper beam for carrying out a bending operation and is adapted to be bent along a bending edge by means of a bending beam, a manipulator device with a gripping means for holding the workpiece, and a positioning device for moving said gripping means in the bending plane in a first direction transversely to the bending edge and rotating it about an axis at right angles to the bending plane, wherein:

said gripping means is adapted to be moved with the positioning device in a second direction parallel to the bending plane and in a vertical direction at right angles to the bending plane, the positioning device has a longitudinal guide means extending parallel to a longitudinal direction for realizing the movement in one of the directions, a longitudinal slide bearing the gripping means is held on said guide means, and the longitudinal guide means is adjustable in the vertical direction by means of a vertical adjustment device.

2. A processing machine as defined in claim 1, wherein a transverse guide means with a cross slide movable thereon is arranged on the longitudinal slide.

3. A processing machine as defined in claim 1, wherein the gripping means grips the workpiece with gripping elements extending over an upper side and a lower side of the workpiece.

4. A processing machine as defined in claim 3, wherein the gripping means has an approximately C-shaped gripper bracket, the gripping elements being held thereon.

5. A processing machine as defined in claim 4, wherein the gripper bracket enables the workpiece to be gripped with the gripping elements in a central region thereof.

6. A processing machine as defined in claim 4, wherein the gripping elements are arranged on the gripper bracket so as to be rotatable relative thereto.

7. A processing machine as defined in claim 4, wherein one of the gripping elements is held on the gripper bracket so as to be movable in a direction towards and away from the other gripping element.

8. A processing machine for workpieces consisting of flat material, comprising:

a work station designed as a bending station, wherein a workpiece aligned parallel to a bending plane is adapted to be clamped by means of a lower beam and an upper beam for carrying out a bending operation and is adapted to be bent along a bending edge by means of a bending beam, a manipulator device with a gripping means for holding the workpiece, a positioning device for moving said gripping means in the bending plane in a first direction transversely to the bending edge and rotating it about an axis at right angles to the bending plane, and several work stations corresponding to said work station arranged one after the other in a longitudinal direction, wherein the workpiece is adapted to be positioned by the gripping means in said several work stations.

9. A processing machine as defined in claim 8, wherein the longitudinal direction extends parallel to the bending edge of the bending station.

10. A processing machine as defined in claim 8, wherein at least one of the additional work stations is designed as a bending station.

11. A processing machine as defined in claim 10, wherein the bending edges of all the bending stations extend parallel to the longitudinal direction.

12. A processing machine as defined in claim 10, wherein all of the bending stations have a common lower beam, a common upper beam and a common bending beam.

13. A processing machine as defined in claim 12, wherein each bending station has its own bending beam tool.

14. A processing machine as defined in claim 12, wherein each bending station has its own upper beam tool and/or its own lower beam tool.

15. A processing machine as defined in claim 8, wherein the workpiece is adapted to be supplied to a feed station of the processing machine and picked up therefrom with the gripping means.

16. A processing machine as defined in claim 15, wherein the workpiece is adapted to be positioned exactly in the feed station.

17. A processing machine as defined in claim 16, wherein the workpiece is adapted to be positioned exactly in the feed station by stop elements provided therein.

18. A processing machine for workpieces consisting of flat material, comprising:

a work station designed as a bending station, wherein a workpiece aligned parallel to a bending plane is adapted to be clamped by means of a lower beam and an upper beam for carrying out a bending operation and is adapted to be bent along a bending edge by means of a bending beam, a manipulator device with a gripping means for holding the workpiece, and a positioning device for moving said gripping means in the bending plane in a first direction transversely to the bending edge and rotating it about an axis at right angles to the bending plane, wherein:

the workpiece is adapted to be fed to a removal station after passing through the work station, and the removal station has at least one conveyor belt, the workpiece being adapted to be placed on said conveyor belt(s) by way of the gripping means.

19. A processing machine as defined in claim 18, wherein the workpiece is held only by the gripping means during feeding to individual work stations and during removal therefrom.

20. A processing machine for workpieces consisting of flat material, comprising:

a work station designed as a bending station, wherein a workpiece aligned parallel to a bending plane is adapted to be clamped by means of a lower beam and an upper beam for carrying out a bending operation and is adapted to be bent along a bending edge by means of a bending beam, a manipulator device with a gripping means for holding the workpiece, a positioning device for moving said gripping means in the bending plane in a first direction transversely to the bending edge and rotating it about an axis at right angles to the bending plane, and a plurality of individual work stations corresponding to said work station, wherein:

the workpiece is adapted to be gripped by the gripping means in a single alignment relative to the gripping elements and transported to the individual work stations in said single alignment.

* * * * *